US006482500B1

(12) United States Patent
Diginosa

(10) Patent No.: US 6,482,500 B1
(45) Date of Patent: Nov. 19, 2002

(54) PREFABRICATED PLASTIC SHED AND COMPONENTS THEREFOR

(75) Inventor: Anthony V. Diginosa, Mississauga (CA)

(73) Assignee: Royal Group Technologies Limited, Woodbridge (CA)

( * ) Notice: Subject to any disclaimer, the term of this patent is extended or adjusted under 35 U.S.C. 154(b) by 0 days.

(21) Appl. No.: 09/438,284

(22) Filed: Nov. 12, 1999

(30) Foreign Application Priority Data

Nov. 12, 1998 (CA) ..... 2254020

(51) Int. Cl.[7] ..... E04F 19/02; E06B 1/62

(52) U.S. Cl. ..... 428/122; 52/211; 52/288.1; 52/717.03; 52/717.04; 52/717.05; 52/717.06; 52/718.04; 428/121; 428/130; 428/156; 428/163; 428/192

(58) Field of Search ..... 428/122, 192, 428/130, 121, 156, 163; 52/718.04, 717.03, 717.04, 717.05, 717.06, 288.1, 211

(56) References Cited

U.S. PATENT DOCUMENTS 4,361,995 A * 12/1982 Buck ..... 52/309.17
4,533,588 A * 8/1985 Kraft ..... 428/167
4,738,069 A * 4/1988 Williams ..... 52/288
5,222,343 A * 6/1993 Anderson ..... 52/718.04

* cited by examiner

*Primary Examiner*—Nasser Ahmad

(57) ABSTRACT

A trim member is made from a single piece of trim material. The trim material has a plurality of spaced apart cut out regions which divide the trim member into a plurality of trim sections. These trim sections are connected to one another by thin strips of the trim material in each cut out region. The strips are bendable and the cut out regions are shaped to enable a reconfiguring of the trim member from a lineal to a trim border forming configuration for use around a door, a window or a windowed wall area of a building wall.

9 Claims, 8 Drawing Sheets

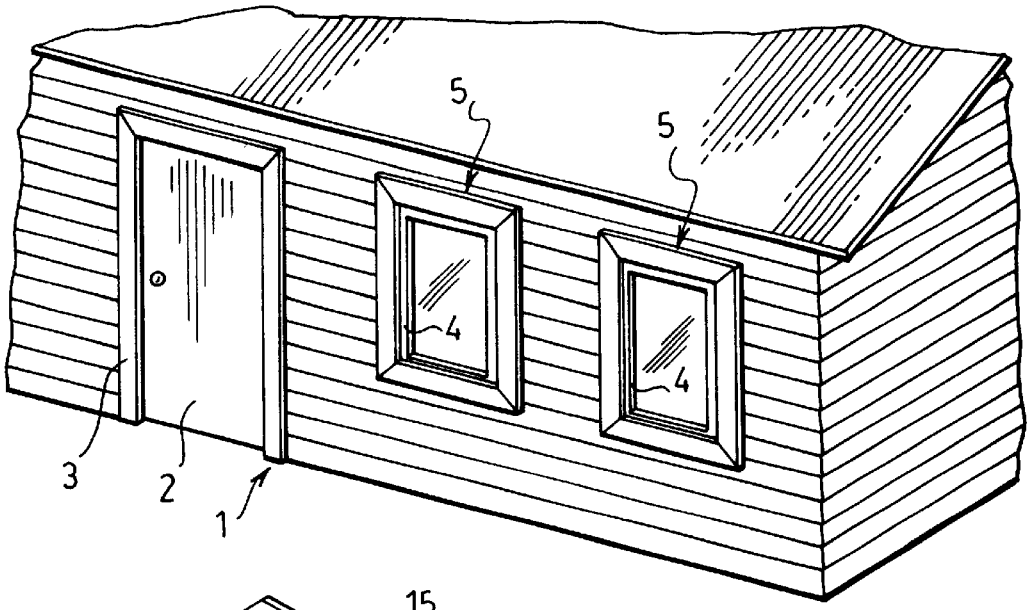
FIG. 1.
FIG. 2.
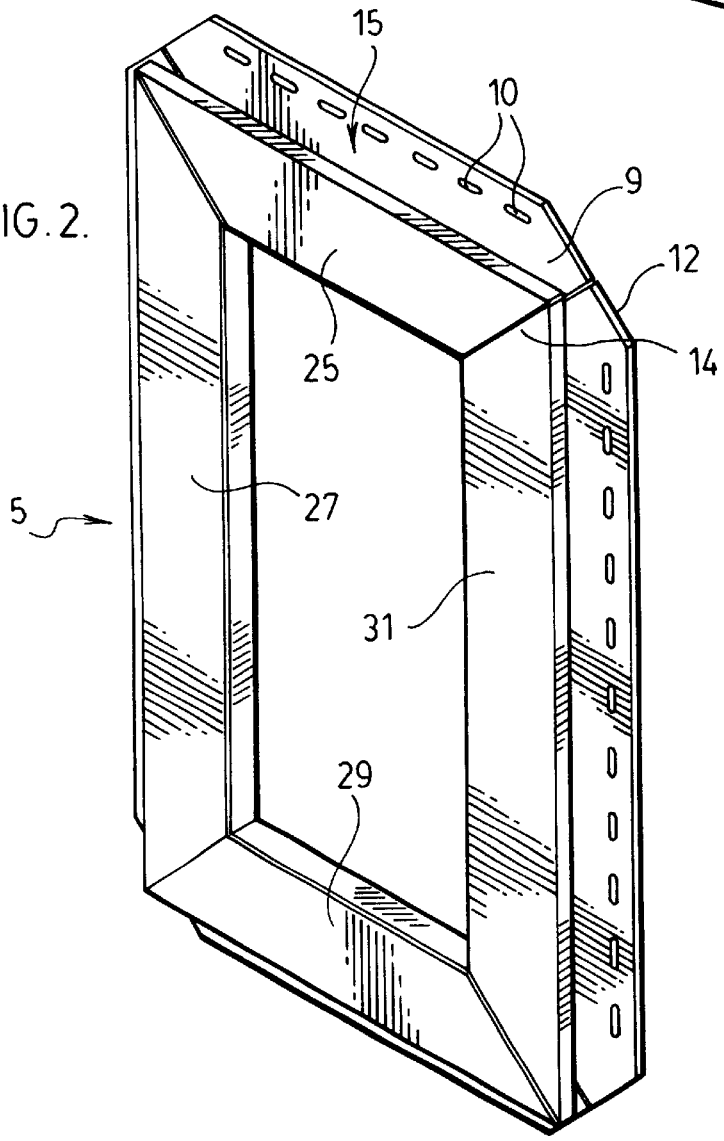

15
9
17
16
13
5
11
12

6

26
25
35
23
24
19
18
21
10
22
9
13
7
27
37
29
39
31
32

26
15
17
23
22
24
9
12
16
12

PREFABRICATED PLASTIC SHED AND COMPONENTS THEREFOR

FIELD OF THE INVENTION

This invention relates to a decorative border trim for doors, windows and window areas and more particularly to a novel one piece trim member which can be bent to a border trim shape.

BACKGROUND OF THE INVENTION

Trim around windows and doors of a building adds substantially to the esthetic appeal of the building. Such trim is currently in wide spread use.

Conventional window and door trim is made up of a plurality of separate trim members which have their ends cut to a abut with one another in forming a border around a window or door. Most windows and doors are typically rectangular and the trim is formed by two jambs, a sill and a header. These trim members are generally mitered at their ends where they are welded or mechanically fastened in forming the window or door border trim.

The assembly of a conventional window or door trim takes time and requires expertise in assembly adding significantly to the cost of installation. Further, for companies having large inventories of trim, there is a need for high levels of inventory control to ensure there is no mix up of the trim members, particularly when there are windows and doors of different shapes and sizes involved.

When working with plastic material for making window and door trim members, even though the shape and size of different trim members may be consistent, the color of the plastic used to make the trim members often varies from batch to batch, once again demanding a high level of inventory control.

SUMMARY OF THE PRESENT INVENTION

The present invention provides a trim member made from a single piece of trim material having a plurality of spaced apart cut out regions which divide the trim member into a plurality of trim sections, e.g. for a rectangular shape, header, sill and jamb sections. These sections remain connected to one another by thin strips of the trim material which are not penetrated by the cut out regions. The strips are bendable and the cut out regions are shaped to enable a reconfiguring of the trim sections from a lineal to a trim border forming configuration for treating a door, a window and even a windowed area of a building wall with the trim member.

As a result of the above unitary construction of the trim member, all of the trim sections are kept together with one another eliminating the need for inventory control associated with individual trim sections. Furthermore, the final assembly of the trim border does not require the expertise associated with assembling totally separate trim members and therefore use of a trim member made in accordance with the present invention substantially reduces installation costs relative to conventional window trims.

BRIEF DESCRIPTION OF THE DRAWINGS

The above as well as other advantages and features of the present invention will be described in greater detail according to the preferred embodiments of the present invention in which;

FIG. 1 is a perspective view of a building having door and window borders made with trim members according to the present invention;

FIG. 2 is an enlarged perspective view of one of the window borders from FIG. 1;

DETAILED DESCRIPTION ACCORDING TO THE PREFERRED EMBODIMENTS OF THE PRESENT INVENTION IN WHICH:

FIG. 1 shows a building generally indicated at 1. This building has a door 2 surrounded by a trim border 3 and windows each having a window frame 4 which is surrounded by a window trim border 5. These trim borders are not used for holding the door or the window frame within the building wall, but rather add a decorative appearance around the door and windows.

According to an aspect of the invention, which will be described later in detail, the border trim does provide a function with respect to edge covering of panelling on the building wall and in particular the edge covering of a vinyl siding.

Figure 3:
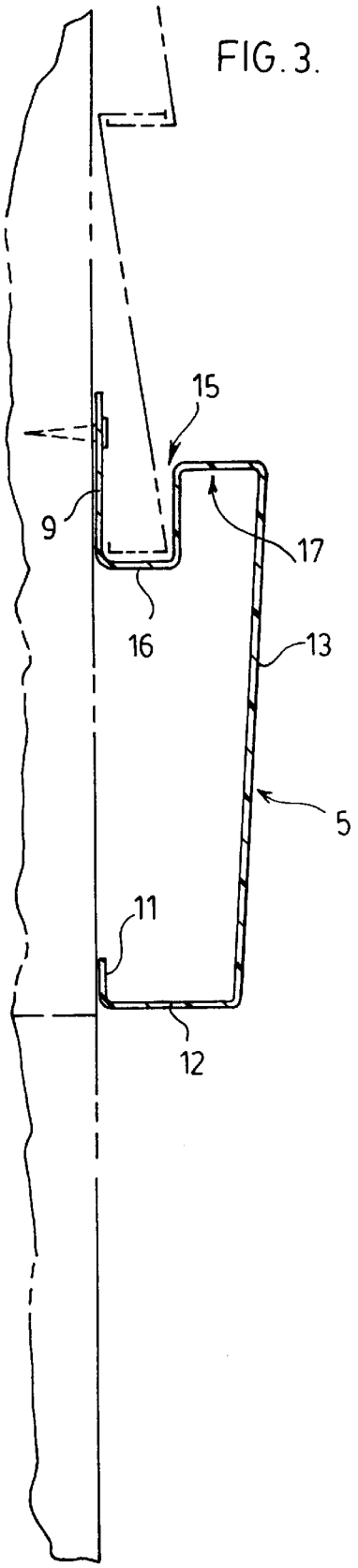
FIG. 3 is a sectional view through one of the window borders of FIG. 1.
Figure 4:
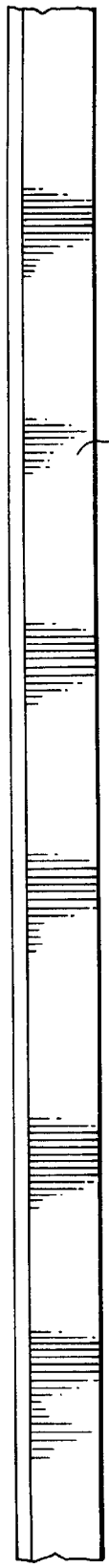
FIG. 4 is a plan view of an extrusion from which a trim member is to be fabricated.

The trim border can be made from various different materials and by different methods of manufacture. For example, the trim border can be made from aluminum or steel, either extruded or rolled, or it can be made from different plastics such as foamed or rigid polyvinyl chloride. Extruding PVC allows the trim member used to form the border to be made with great accuracy in an extrusion process. This process begins with the formation of a continuous length blank 6 shown in FIG. 4 of the drawings. This blank includes a base portion comprising base parts 9 and 11 which, as shown in FIG. 3, seat against the building wall. Also provided in the blank 6 is a decorative part 13 which is raised relative to the base parts. Provided along one side of the blank is a generally U-shaped panel or siding edge receiving recess 15. This recess has an interior wall 16 and is bordered to one side by a hollow region 17 within the decorative part of the blank.

In order to provide a trim member specific to a particular window, the blank 6 is cut to a length substantially equal to the circumference of the window frame to be bordered by the trim member. In addition, a series of openings and cut outs are provided in the blank to arrive at a lineal trim member 7 shown in FIG. 4*a* of the drawings.

More particularly, base part 9 of the trim member is provided with openings 10 along its complete length in forming a nailing fin for the trim member.

In addition, a series of cut out regions 18 are spaced lengthwise from one another of the trim member. These cut out regions divide the trim member into a plurality of trim sections 25, 27, 29 and 31.

Each of the cut out regions 18 comprises a relatively small cut out 19 made into one side of the trim member and a much more substantial cut out 21 made into the other side of the trim member. The apexes of these two cut outs do not meet but rather are separated from one another by a thin strip 35 of the trim material which is not penetrated by the two cut outs.

The number of cutout regions provided dictates the number of trim sections in the trim member. The location of the cut out regions dictates the length of each trim section.

In the case of trim member 7, there are three cut out regions producing the four trim sections 25, 27, 29 and 31 noted above. This trim member is then used to form a rectangular border trim.

It is to be understood that further cut out regions could be provided when it is desired to make a trim member for window frames having more than four sides such as a hexagonal or even an octagonal window frame.

The location of the three cut out regions 18 in trim member 7 is such that trim sections 25 and 29 are of the same length and both of these trim sections are shorter than the equal length trim sections 27 and 31. As will be described later in greater detail, trim sections 25 and 29 end up producing a header and a sill respectively for the border trim while trim sections 27 and 31 end up producing jambs for the border trim.

Figure 4A:
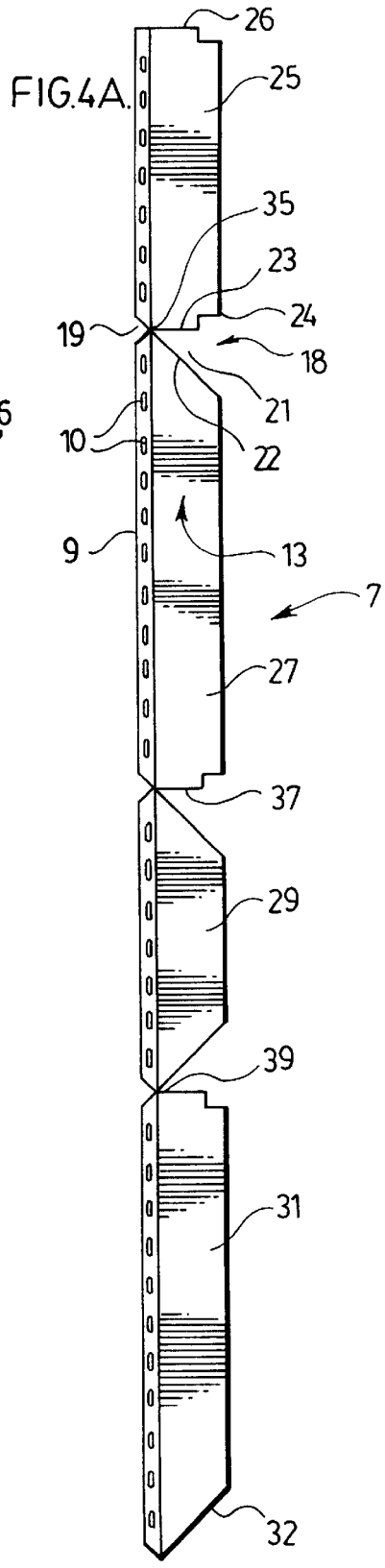
FIG. 4A is a plan view of a window trim member according to an embodiment of the invention made from the extrusion of FIG. 4 with the trim member in a lineal configuration before being reconfigured to the closed configuration of FIG. 2.
Figure 5:
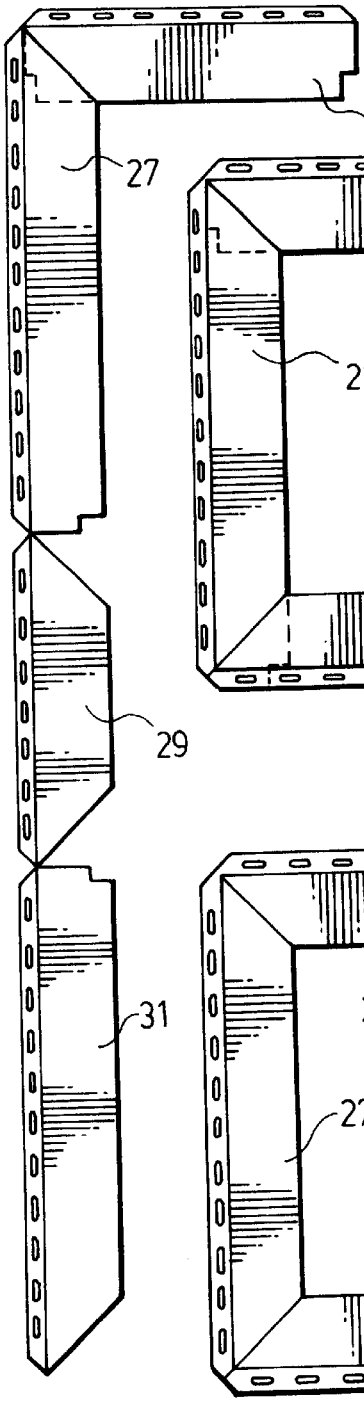
FIGS. 5 through 8 of the drawings show the various stages of reconfiguring the trim member from the FIG. 4A to the FIG. 2 configuration.
Figure 6:
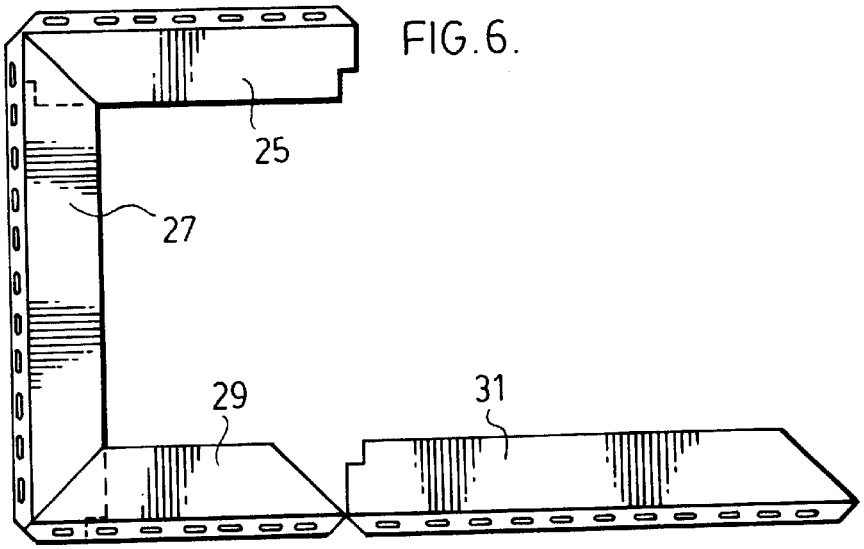
Figure 7:
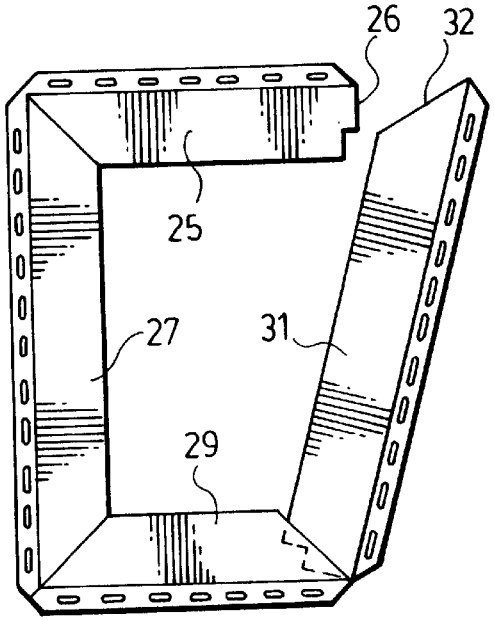
Figure 8:
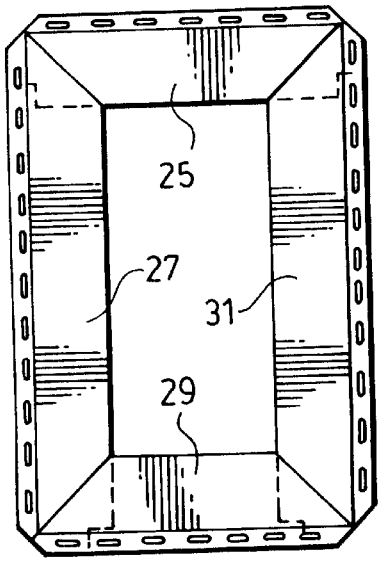

The particular shaping of each of the cut outs 21 enables reconfiguring of trim member 7 from its lineal configuration of FIG. 4*a* to the closed configuration of FIG. 2.

More particularly, the cut out 21 of each cut out region has a generally right triangular shape. This shape produces a wall 22 along one side of the cut out. Wall 22 is angled at 45° to the axis of the trim member. The other side of the cut out is notched to produce a first wall portion 23 and a second shorter wall portion 24 a right angle step is provided between wall portions 23 and 24.

The small cut out 19 of each cut out region 18 is V-shaped with a contained 90° angle. This shaping not only enables reconfiguring or bending of trim member 7 but also enhances the final appearance of the trim border shown in FIG. 2. In particular, it produces a flat truncated corner on the nail fin hidden beneath the decorative part of the border trim.

It should be noted in FIG. 4*a* that the opposite ends 26 and 32 of the trim member have the same shape as the walls in each cut out region. This is because trim member 7 is only part of a much longer extruded forming piece with additional identical cut out regions and severed at two of those cut out regions to produce trim member 7.

Once the trim member 7 has been appropriately prepared as shown in FIG. 4*a*, it is a very simple matter to accurately form the border trim as better shown in FIGS. 5 through 8 of the drawings. This is achieved by reconfiguring trim member 7 from its lineal to its closed shape by bending the thin strips 35 connecting the trim sections. In the sequence of bending shown in FIGS. 5 through 8, which is only one of the many sequences that can be used, trim section 25 is folded through a 90° angle at the one end of trim section 27 by bending the thin strip of material between these two trim sections. The next step is to fold trim section 29 through a 90° angle at the other end of trim section 21 once again bending the thin strip of material between these two trim sections. Finally, trim section 31 is folded at the end of trim section 29 by bending the thin strip of material between these two particular trim sections such that trim section 31 is at 90° to both trim section 29 and trim section 25. This completes the closure of the trim border.

The trim member is designed to ensure the desired 90° angle between each trim section. This in turn enables a very easy and accurate installation of the border trim.

Figure 9:
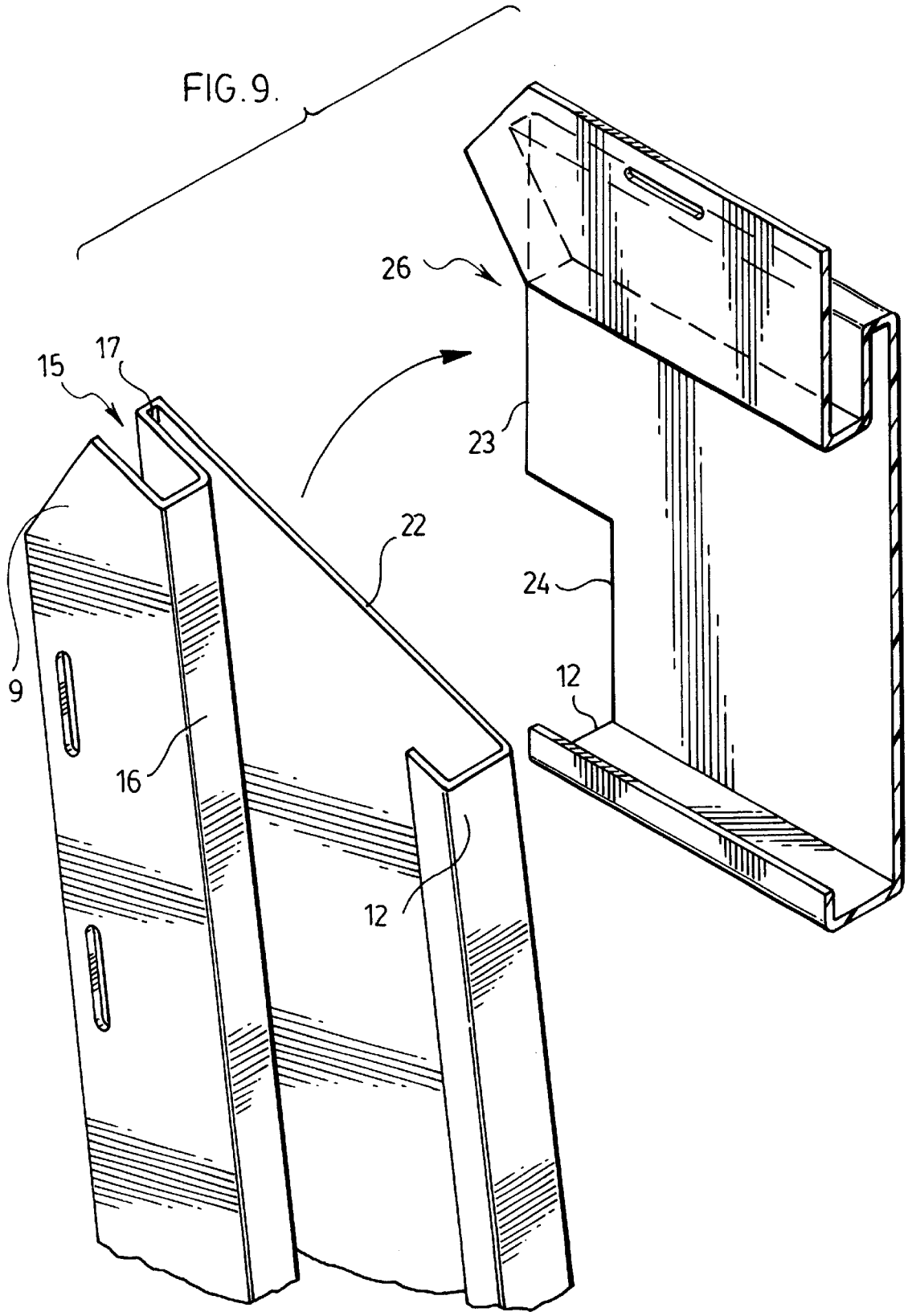
FIGS. 9 and 10 are enlarged perspective views showing the final stages of bringing together the opposite ends of the trim member of FIG. 4A to complete the closed configuration of the window trim member.

More particularly the accurate bending of the various trim sections in provided as a result of the unique shaping of each of the cut outs 21. The description of this is best made having reference to FIGS. 3, 9 and 10 of the drawings. various trim sections in provided as a result of the unique shaping of each of the cut outs 21. The description of this is best made having reference to FIGS. 3, 9 and 10 of the drawings.

Here it will be seen that the cut out shape has been designed to allow the folding of the trim member upon itself without interference from the base wall 16 of recess 15. It is a combination of the angled cut of wall 22 and the notch in forming walls 23 and 24 which allow the folding. More specifically, as will be seen in FIG. 3, each trim member section has an interior wall 12 between base part 11 and the outer decorative wall surface 13. This return wall 12 is cut off of each trim section along the length of angled wall 22. This allows the facing notched wall to be folded past the angled wall 22. The folding is completed when wall 23 of one trim section is fully nested within hollow region 17 and of the trim section into which it is folded. At the same time, the return wall 12 of the trim section being folded abuts the base wall 16 of the channel 15 of the other trim section against which it is being folded. This ensures the 90° fold.

Figure 10:
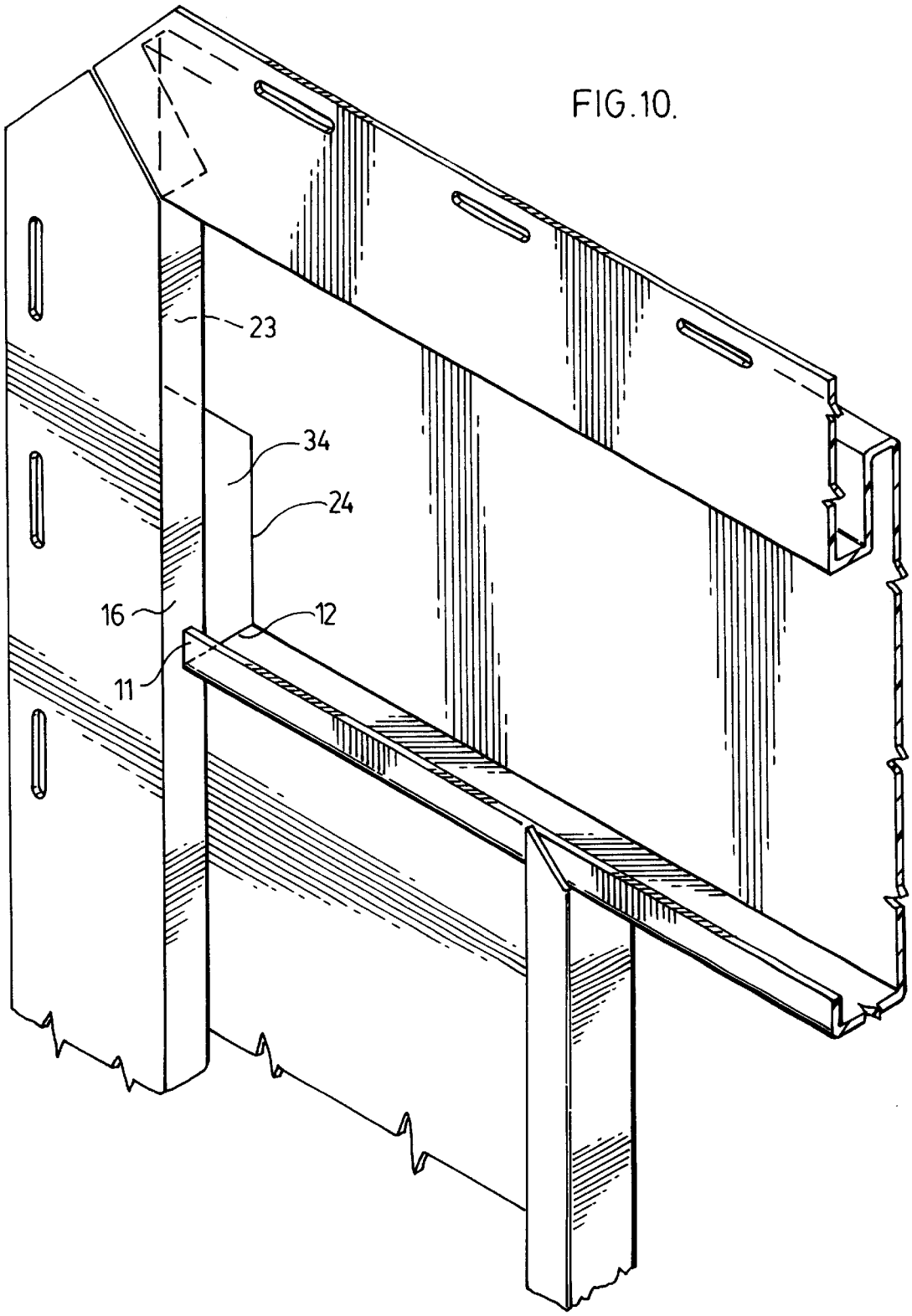

FIG. 10 also shows that the notch which allows the full 90° folding of the two trim sections relative to one another leaves an opening in the decorative part of each trim member having a notched end. However, because the notched end is folded behind the decorative part of the adjacent trim member, opening 24 is covered and not visible from the front side of the border trim.

When the border trim is being mounted, it is a very simple matter to first line up and then nail the header, e.g. trim section 25 in place. As a result of the exact 90° folding of the trim member sections, this FIG. 3 shows that after the border trim has been placed around the window wall panelling such as vinyl siding can then be applied to the building wall with the edge of the siding hidden in recess 15. The recess, which is sufficiently deep to accommodate expansion and contraction of the vinyl siding, eliminates the need to provide a vinyl siding recess in the actual frame of the window.

Figure 11:
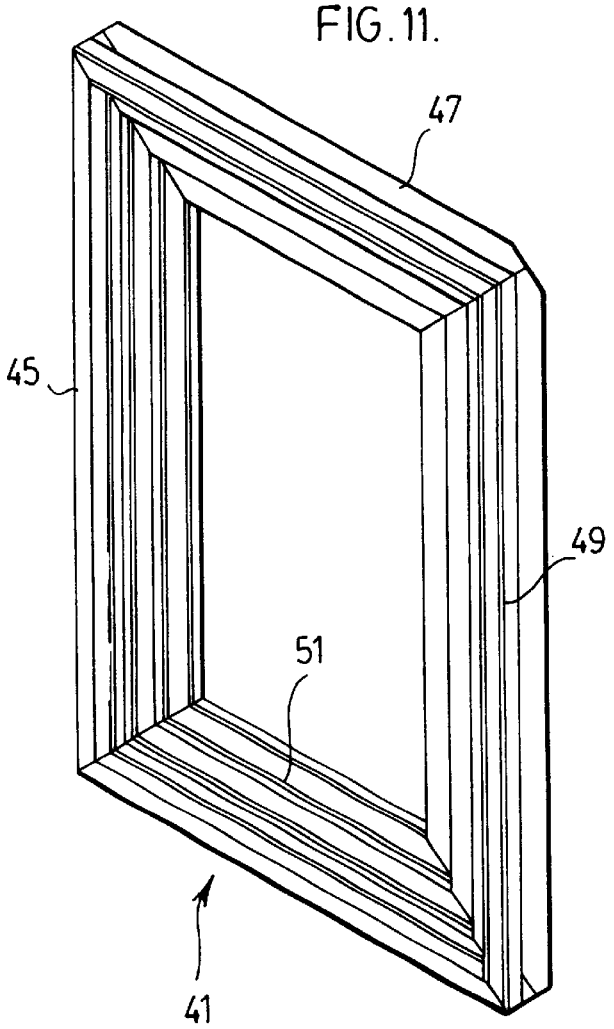
FIG. 11 is a perspective view of a window border made from a trim member having a slightly different configuration from that shown in FIGS. 1 through 10.

FIGS. 11 though 16 show a window border trim made with the same features as, but having a slightly different decorative appearance from the border trim described above.

Figure 13:
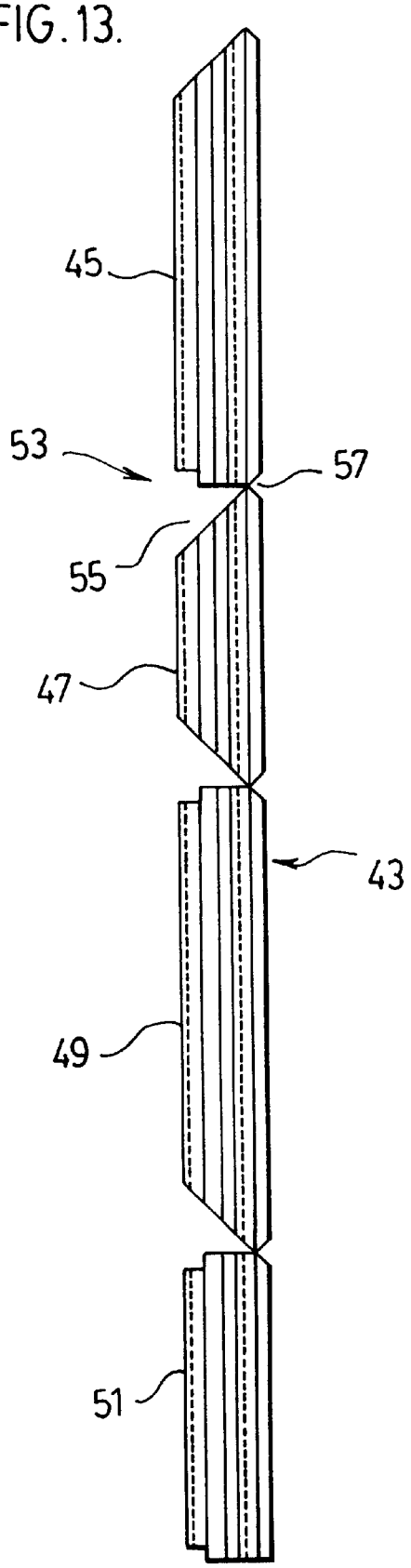
FIG. 13 is a plan view of the trim member used to make the window border of FIG. 11 while the trim member is in its lineal configuration prior to reconfiguring to a closed configuration.
Figure 14:
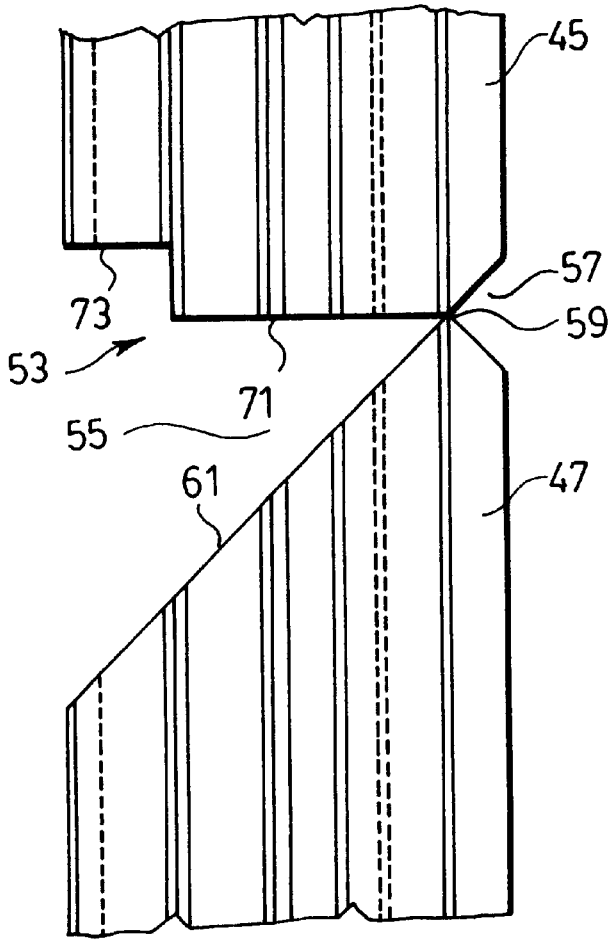
FIG. 14 is an enlarged plan view of one of the cut out regions of the trim member of FIG. 13.

More specifically, FIG. 11 shows a window border trim 41 which is formed from a trim member 43 shown in FIG. 13. This trim member comprises a plurality of trim sections 45, 47, 49 and 51. These trim sections are defined by a plurality of cut out regions 53 lengthwise of the trim member. Each of these cut out regions comprises a major cut out 55 and a minor cut out 57 from opposite sides of the trim member. As shown in FIG. 14, these two cut outs are separated by a thin strip 59 of trim material.

Cut out 55 is bordered to one side by an angled wall 61 and to the other side by a stepped or notched wall comprising wall portions 71 and 73.

Figure 12:
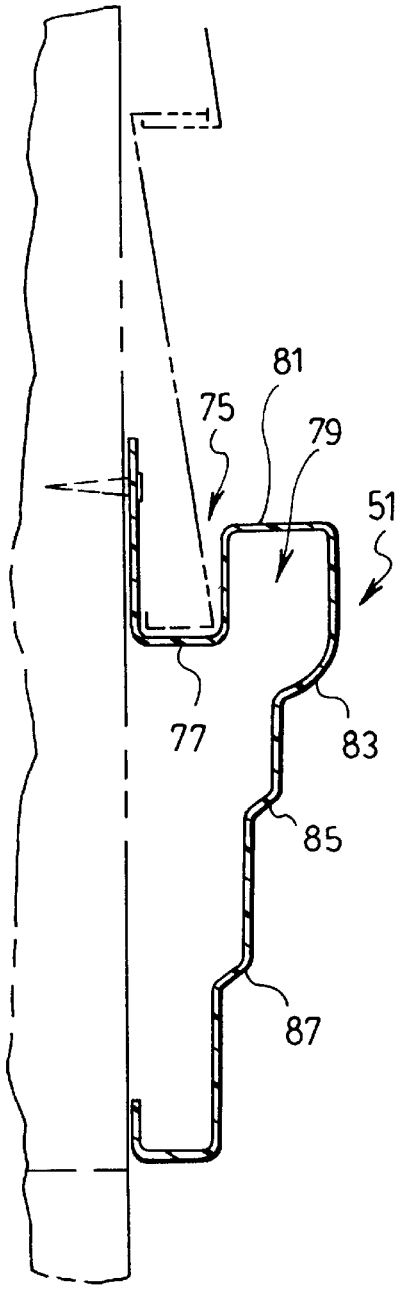
FIG. 12 is a sectional view through the window border of FIG. 11.

As shown in FIG. 12 of the drawings, each of the trim sections as exemplified by trim section 51 of border trim 41 has a tiered decorative surface with the tiers being separated by step downs 83, 85 and 87.

The border trim again includes a panel receiving recess 75 which separates the raised decorative part from the base part of the trim. Recess 75 has a base wall 77 and is bordered to its exterior side by a hollow region 79 within the trim member. This hollow region is closed by an edge wall 81.

Figure 15:
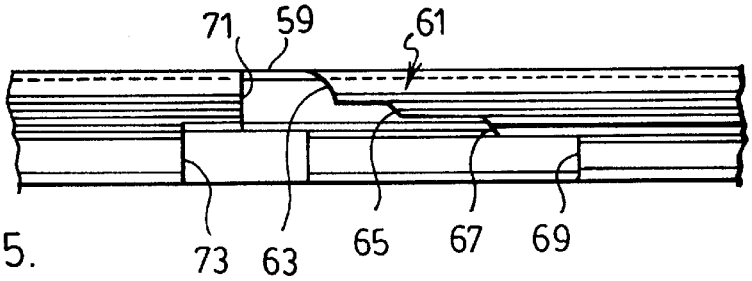
FIG. 15 is an edge view of the cut out region of the trim member FIG. 14.
Figure 16:
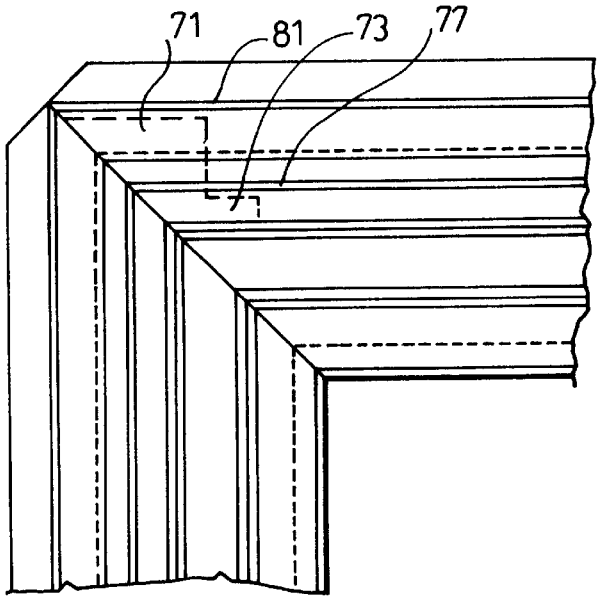
FIG. 16 is a plan view of one of the corner regions of the window border of FIG. 11.

Referring to FIG. 15 of the drawings, it will be seen from the edge of the trim member that the angled cutting of cut out 55 resulting in wall 61 produces a series of steps 63, 65 and 67. With the folding of the trim member, these steps which are provided for example at the opposite ends of trim section 47 will match up with the step downs 83, 85 and 87 of the trim sections 45 and 49 against which trim section 47 is folded. At the same time, the end wall portions 71 and 73 of trim section 45 will move into position against the walls 81 and 77 respectively of trim section 47 as shown in FIG. 16 of the drawings. This ensures a 90° fold between the two trim sections. This 90° fold is also guaranteed at each of the other folded corners of border trim 41.

It is to be appreciated that the shape of the cut outs in the trim member will vary according to the angle that the trim sections are folded relative to one another. The cut outs described above are used to form a rectangular border where the trim sections fold at 90° to one another. If however there is less then a 90° folding of trim sections, as found for example in a hexagonal trim border, less material would need to be cut out of the trim member at each cut out resulting in a different shaped cut out to produce the desired folding.

All of the description above relates to the window trim of FIG. 1. The door trim is formed in the same manner except that the trim member for the door is formed with three rather than four trim sections and these sections are folded to a partially closed configuration, i.e. a U-shape rather than the completely closed shape used to circumscribe the windows.

Figure 17:
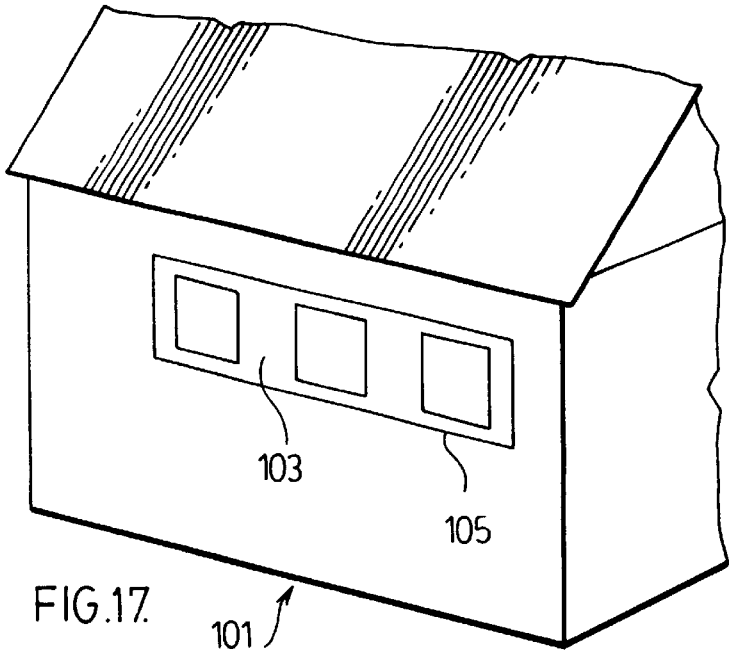
FIG. 17 is a perspective view of a building showing decorative trim according to another aspect of the invention.

FIG. 17 shows a building 101 having a group of windows provided in a wall area 103 of the building. Wall area 103 is bordered by a one piece trim border 105. This border again completely closes upon itself.

FIG. 17 clearly demonstrates that the trim can be used to border an area of a building wall rather than having to be placed directly around each individual window. The trim then provides a noticeable framing of the area that it circumscribes. This type of trim may not include a panel edge channel but rather may seat directly on the siding or other covering material on the building wall.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A trim member formed in a lineal configuration and made from a single piece of trim forming material, the trim member including a base part which provides a nailing fin for said trim member, said trim member having a plurality of cut out regions spaced from one another along the trim member, the cut out regions dividing the trim member into a plurality of trim sections all of which include portions of said nailing fin, said trim sections being connected to one another by thin strips of the trim forming material, each cut out region comprising first and second cut outs which are located to opposite sides of the trim member and which are separated from one another by one of the thin strips of the trim forming material, said trim member being bendable at said thin strips of the trim forming material from the lineal configuration to a trim border forming configuration, the portions of the nailing fin of the trim sections being coplanar with one another when the trim member is in the lineal configuration and remaining coplanar with one another when the trim member is bent to the trim border forming configuration.

2. A trim member as claimed in claim 1 including a decorative part raised relative to and separated from said nailing fin by a siding receiving channel, said decorative part and said siding receiving channel also being formed from said single piece of trim forming material, all of said trim sections including portions of said decorative part and portions of said siding receiving channel, the portions of the decorative part being coplanar with one another both before and after bending of the trim member to the trim border forming configuration, the portions of the siding receiving channel being coplanar with one another both before and after bending of the trim member to the trim border forming configuration.

3. A trim member as claimed in claim 2 wherein said base part extends laterally beyond said decorative part of said trim member.

4. A trim member as claimed in claim 1 wherein the trim forming material is selected from the group of materials consisting of plastic material, steel material and aluminium material.

5. A trim member as claimed in claim 1, wherein each first cut out is small relative to each second cut out and each first cut out has a V-shape having a right angled apex and each second cut out having a generally right triangular shape.

6. A trim member as claimed in claim 5, wherein in each cut out region, the second cut out has an apex separated from the apex of the first cut out by one of said thin strips of the trim material.

7. A trim member as claimed in claim 6, wherein said generally right triangular shape of each second cut out is bordered by first and second edge walls, said first edge wall being angled at 45° to said second edge wall, said second edge wall having an end region provided with a rectangular notch remotely of the apex of said second cut out.

8. A trim member as claimed in claim 2, wherein said siding receiving channel has a base wall and is bordered to one side by a hollow region closed by an edge wall of said decorative part of said trim member, said base wall and said edge wall forming steps to provide an exact angle folding of said trim sections relative to one another.

9. A trim member as claimed in claim 2, wherein said decorative part has multiple tiers and wherein each cut out region includes stepped cuts to provide a mating folding of said trim sections upon one another.

* * * * *